US008930093B2

(12) United States Patent
Nishiwaki et al.

(10) Patent No.: US 8,930,093 B2
(45) Date of Patent: Jan. 6, 2015

(54) FORKLIFT TRUCK

(71) Applicant: Kabushiki Kaisha Toyota Jidoshokki, Kariya-shi, Aichi-ken (JP)

(72) Inventors: Takashi Nishiwaki, Aichi-ken (JP); Junichi Kuwayama, Aichi-ken (JP); Tadashi Yamada, Aichi-ken (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 24 days.

(21) Appl. No.: 13/626,210

(22) Filed: Sep. 25, 2012

(65) Prior Publication Data

US 2013/0085646 A1 Apr. 4, 2013

(30) Foreign Application Priority Data

Sep. 29, 2011 (JP) ..... 2011-214449

(51) Int. Cl.

| | |
|---|---|
| ***B66F 1/00*** | (2006.01) |
| ***B66F 9/08*** | (2006.01) |
| ***B66F 9/20*** | (2006.01) |
| ***B66F 9/24*** | (2006.01) |

(52) U.S. Cl.

CPC . *B66F 9/082* (2013.01); *B66F 9/20* (2013.01); *B66F 9/24* (2013.01)

USPC ..... 701/50; 701/49; 701/22; 414/363; 414/634; 187/287; 187/282; 187/224; 187/222

(58) Field of Classification Search

CPC ..... B66F 17/003; B66F 9/06; B66F 19/00; B60G 2300/022; B62D 1/28; G05B 13/0275; B60W 2050/0057

USPC ..... 180/306, 315; 187/223, 224, 282, 287; 414/490, 499, 636, 663; 701/22, 49, 50

See application file for complete search history.

(56) References Cited

U.S. PATENT DOCUMENTS

| | | | |
|---|---|---|---|
| 6,092,976 | A | 7/2000 | Kamiya |
| 6,164,415 | A | 12/2000 | Takeuchi et al. |

(Continued)

FOREIGN PATENT DOCUMENTS

| | | | |
|---|---|---|---|
| EP | 0 866 027 | A2 | 9/1998 |
| JP | 9-25099 | A | 1/1997 |
| JP | 9-295800 | A | 11/1997 |

OTHER PUBLICATIONS

Extended European Search Report for corresponding EP Patent Application No. 12185635.5 issued on Nov. 30, 2012.

*Primary Examiner* — Helal A Algahaim
*Assistant Examiner* — Jelani Smith
(74) *Attorney, Agent, or Firm* — Sughrue Mion, PLLC

(57) ABSTRACT

A forklift truck includes a truck body, a fork, a mast, tilting and lifting mechanisms, tilt and lift levers, tilting and lifting operation detectors, a lifted height detector, a load detector, an auxiliary switch, a tilt angle detector and a controller. The controller controls the lifting and tilting mechanisms based on signals from the tilting and lifting operation detectors and the auxiliary switch. The controller controls the lifting and tilting mechanisms to cause the fork to be lifted and tilted to horizontal position of the fork if a load is present on the fork, the fork is in a lower lift region where the lifted height of the fork is at or lower than a first threshold value, the lift lever is placed in operative position to lift the fork, the auxiliary switch is in operative position and the fork is not in the horizontal position of the fork.

7 Claims, 11 Drawing Sheets

(56) References Cited

U.S. PATENT DOCUMENTS

| | | | | |
|---|---|---|---|---|
| 6,425,728 | B1 * | 7/2002 | Goto | 414/636 |
| 7,320,385 | B2 | 1/2008 | Katae | |
| 2001/0030085 | A1 * | 10/2001 | Nagata et al. | 187/222 |
| 2001/0031196 | A1 * | 10/2001 | Tanaka | 414/634 |
| 2003/0024132 | A1 * | 2/2003 | Kokura et al. | 33/712 |
| 2005/0281650 | A1 * | 12/2005 | Bozem et al. | 414/490 |
| 2008/0011530 | A1 * | 1/2008 | Oka et al. | 180/65.3 |

* cited by examiner

FORKLIFT TRUCK

BACKGROUND OF THE INVENTION

The present invention relates to a forklift truck having a tilting mechanism and a lifting mechanism.

A forklift truck is known which has a lifting mechanism that lifts or lowers a fork of the truck for placing a load on a pallet onto a shelf and removing such load from the shelf. The forklift truck also has a tilting mechanism that tilts the fork frontward and rearward for preventing the load from falling off from the pallet. Japanese Patent Application Publication No. 9-295800 discloses a forklift truck equipped with a tilting mechanism having a leveling pushbutton switch which is operated to cause the fork being tilted to be stopped automatically when the fork reaches its horizontal position. Thus, the truck operator can move the fork to its horizontal position easily without making visual adjustment of the tilt angle of the fork.

In order to ensure safety and stability in loading operation of the forklift truck, it is important to consider the lifted position or height of the fork at which the fork should start to be tilted. However, the above Publication gives no account of the tilting operation in connection with the lifting operation.

The present invention is directed to providing a forklift truck that provides safety and stability in the loading operation by allowing the fork to be tilted in dependence on the lifted position of the fork.

SUMMARY OF THE INVENTION

In accordance with the present invention, a forklift truck forklift truck includes a truck body, a fork a mast, a tilting mechanism, a lifting mechanism, a tilt lever, a lift lever, a tilting operation detector, a lifting operation detector, a lifted height detector, a load detector, an auxiliary switch, a tilt angle detector and a controller. The tilting mechanism is adapted to tilt the mast relative to the truck body. The tilt lever is adapted to operate the tilting mechanism. The tilting operation detector is adapted to detect whether or not the tilt lever is in operative position. The lifting mechanism is adapted to lift and lower the fork along the mast. The lift lever is adapted to operate the lifting mechanism. The lifting operation detector is adapted to detect whether or not the lift lever is in operative position. The lifted height detector detects the lifted height of the fork. The load detector is adapted to detect whether or not a load is present on the fork. The auxiliary switch is disposed at a position which allows the operator to operate the auxiliary switch. The tilt angle detector is adapted to detect a tilt angle of the mast. The controller is adapted to control the tilting mechanism and the lifting mechanism based on signals from the tilting operation detector, the lifting operation detector and the auxiliary switch. The controller controls the lifting mechanism and the tilting mechanism to cause the fork to be lifted and tilted to horizontal position of the fork if the load detector detects that a load is present on the fork, the fork is in a lower lift region where the lifted height of the fork detected by the lifted height detector is at or lower than a first threshold value, the lifting operation detector detects that the lift lever is placed in operative position to lift the fork, the auxiliary switch is in operative position and the controller detects that the fork is not in the horizontal position of the fork based on a signal from the tilt angle detector.

In accordance with the present invention, the forklift truck includes a truck body, a fork a mast, a tilting mechanism, a lifting mechanism, a tilt lever, a lift lever, a tilting operation detector, a lifting operation detector, a lifted height detector, a load detector, an auxiliary switch, a tilt angle detector and a controller. The mast is movable to be lifted, lowered and tilted together with the fork. The tilting mechanism is adapted to tilt the mast relative to the truck body. The tilt lever is adapted to operate the tilting mechanism. The tilting operation detector is adapted to detect whether or not the tilt lever is placed in operative position. The lifting mechanism is adapted to lift and lower the fork along the mast. The lift lever is adapted to operate the lifting mechanism. The lifting operation detector is adapted to detect whether or not the lift lever is placed in operative position. The lifted height detector is adapted to detect the lifted height of the fork. The load detector is adapted to detect whether or not a load is present on the fork. The auxiliary switch is disposed at a position which allows the operator to operate the auxiliary switch. The tilt angle detector is adapted to detect a tilt angle of the mast. The controller is adapted to control the tilting mechanism and the lifting mechanism based on signals from the tilting operation detector, the lifting operation detector and the auxiliary switch. A method for the forklift truck includes the steps of controlling the lifting mechanism to cause the fork to be lowered if the load detector detects that a load is present on the fork, the fork is in a higher lift region where the lifted height of the fork detected by the lifted height detector is higher than a first threshold value, the lifting operation detector detects that the lift lever is placed in operative position to lower the fork and the auxiliary switch is in operative position or controlling the lifting mechanism and tilting mechanism to cause the fork to be lifted and tilted to the horizontal position of the fork if the load detector detects that a load is present on the fork and the fork is in a lower lift region where the lifted height of the fork detected by the lifted height detector is at or lower the first threshold value, the lifting operation detector detects that the lift lever is placed in operative position to lift the fork and the auxiliary switch is in operative position, and controlling the tilting mechanism to cause the fork to be tilted to horizontal position of the fork if the fork reaches the lower lift region from the higher lift region or controlling the tilting mechanism to cause the fork to be stopped from tilting if the fork is reaches the higher lift region from the lower lift region.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

Figure 6:
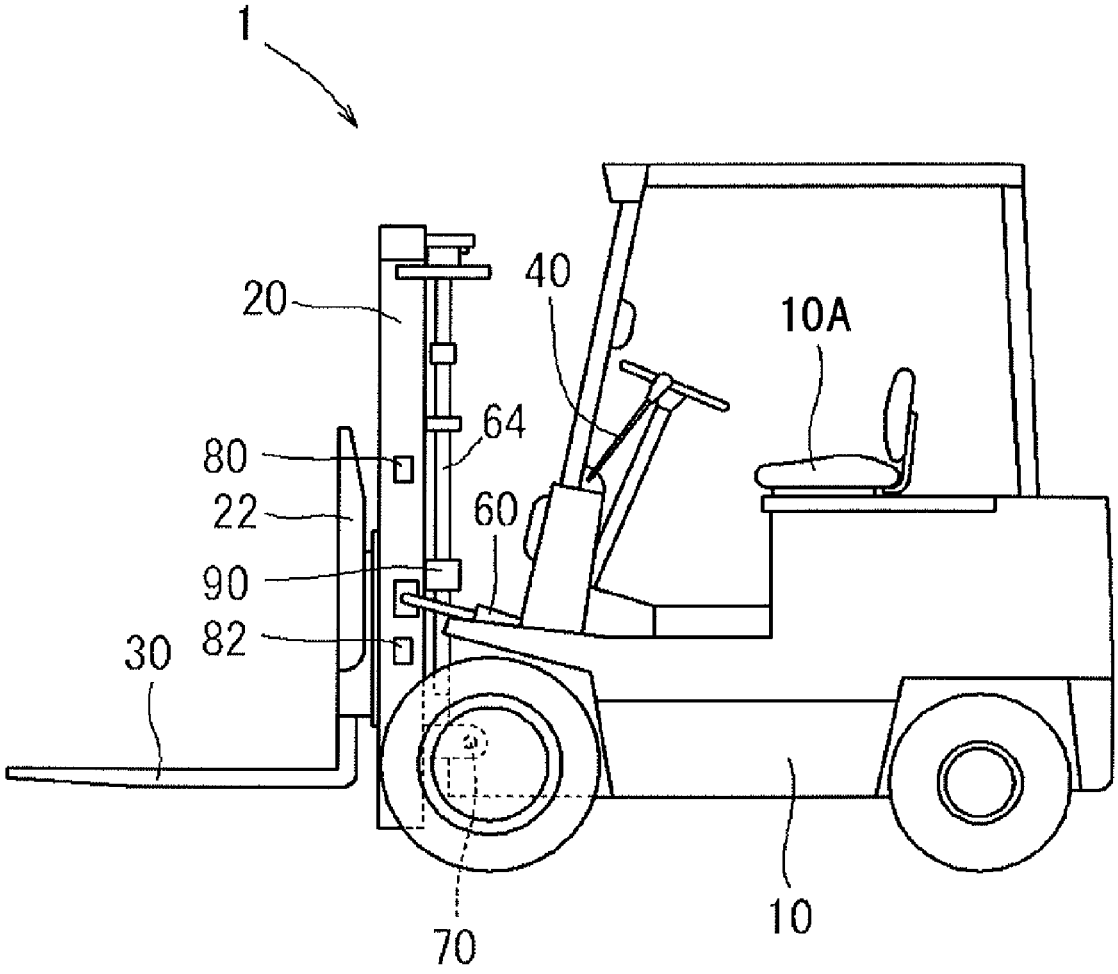
Figure 7:
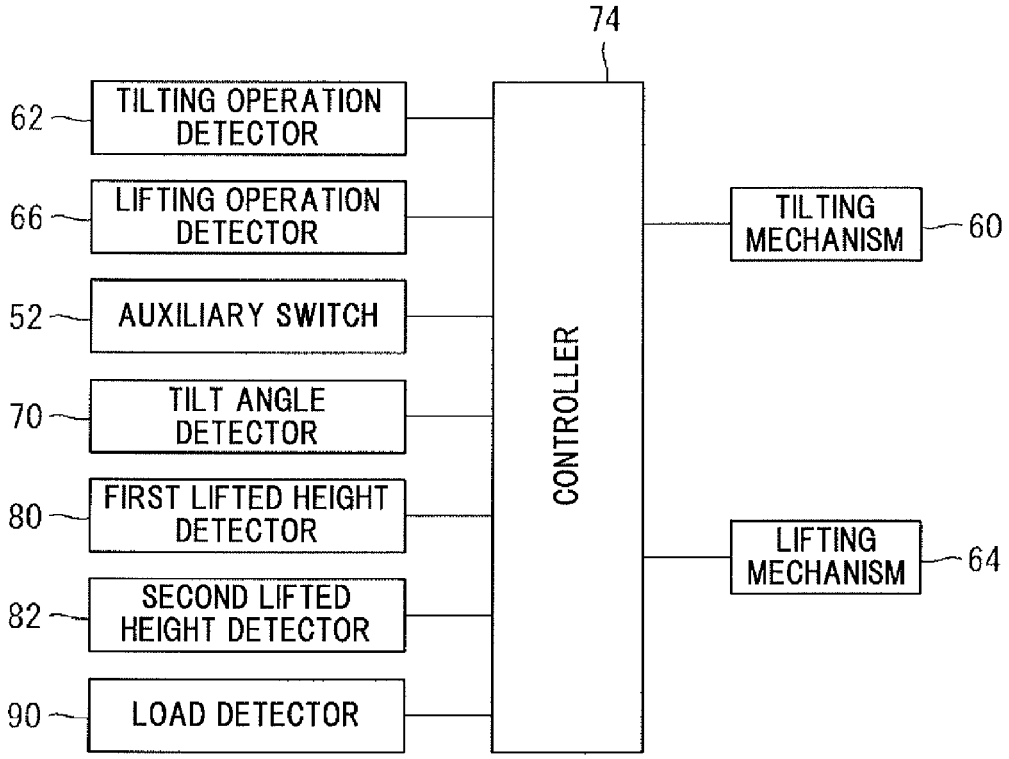
Figure 8:
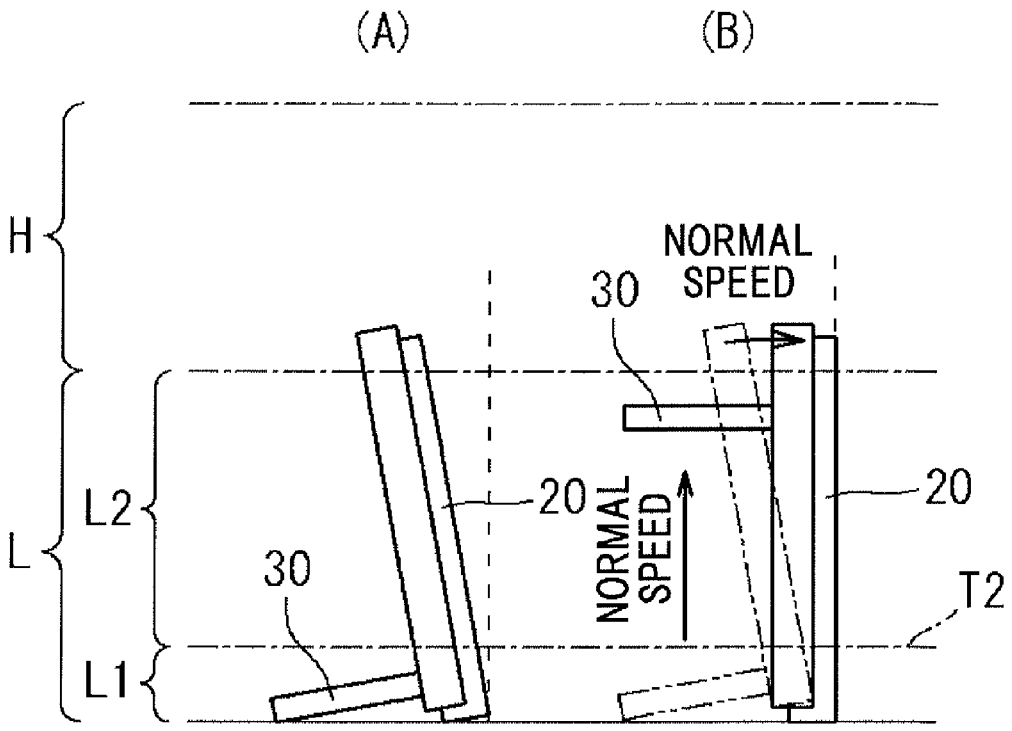
Figure 9:
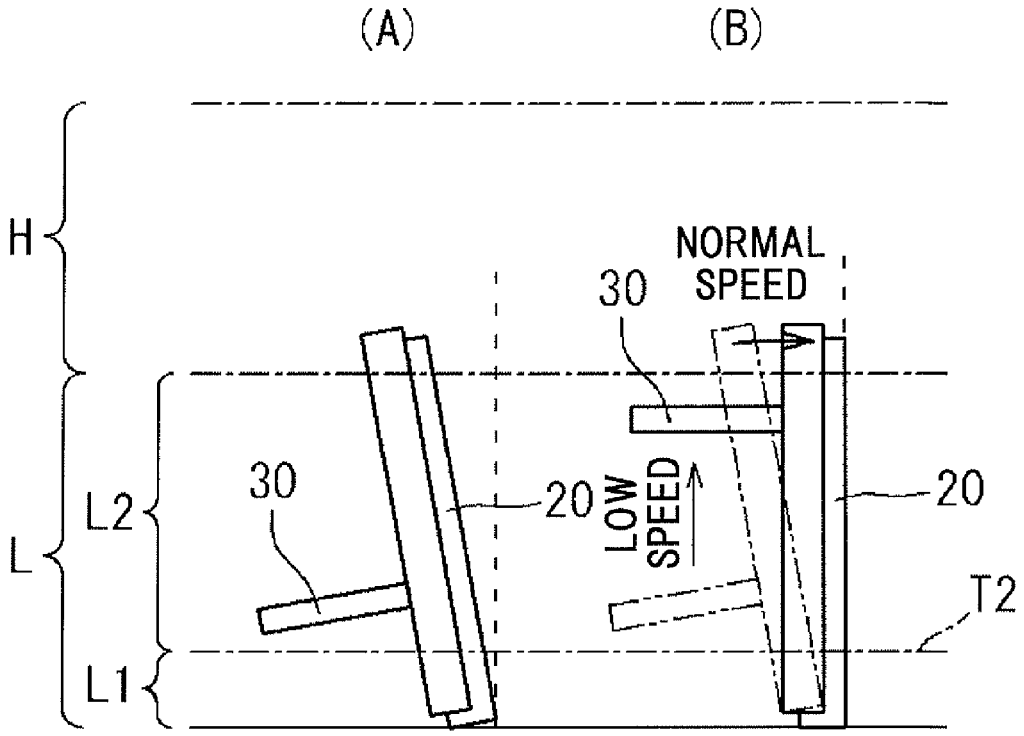
Figure 10:
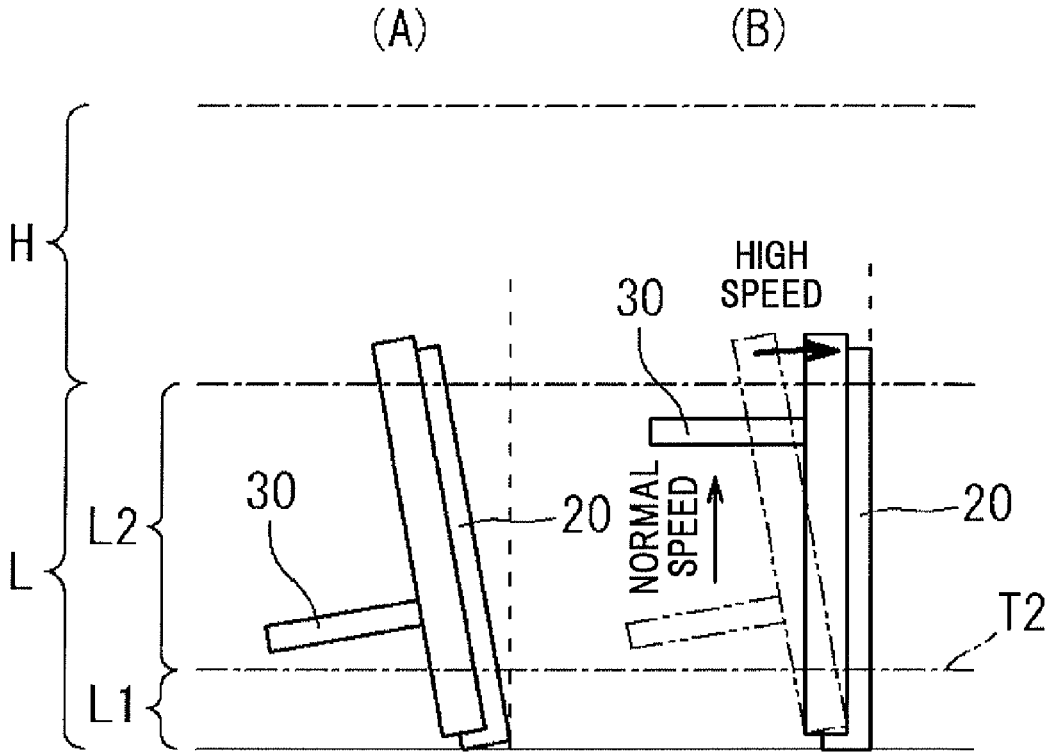
Figure 11:
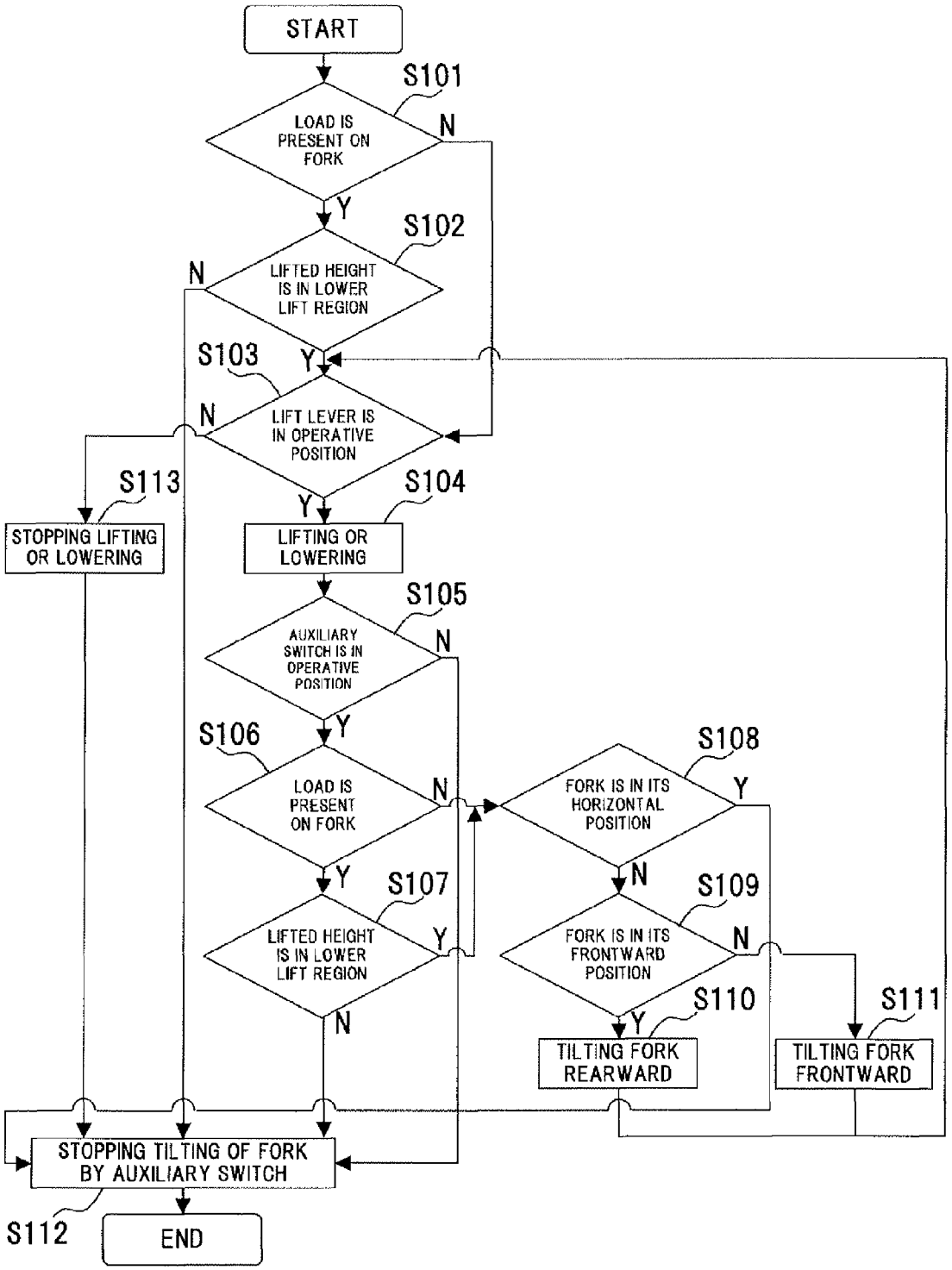

The FIG. 6 is a schematic side view of a forklift truck according to a third preferred embodiment of the present invention;

FIG. 7 is a block diagram showing the electrical arrangement of the forklift truck of FIG. 6;

FIG. 8 is a schematic view showing the operation of the mast and the fork of the forklift truck of FIG. 6 when the fork is in its first lower lift region;

FIG. 9 is a schematic view showing the operation of the mast and the fork of the forklift truck of FIG. 6 when the fork is in its second lower lift region;

FIG. 10 is a schematic view showing the operation of the mast and the fork of a forklift truck according to a fourth preferred embodiment of the present invention when the fork is in its second lower lift region; and FIG. 11 is a flow chart illustrating the operation of a forklift truck according to a modification of the first preferred embodiment of the present invention.

DETAILED DESCRIPTION OF THE PREFERRED EMBODIMENTS

Figure 1:
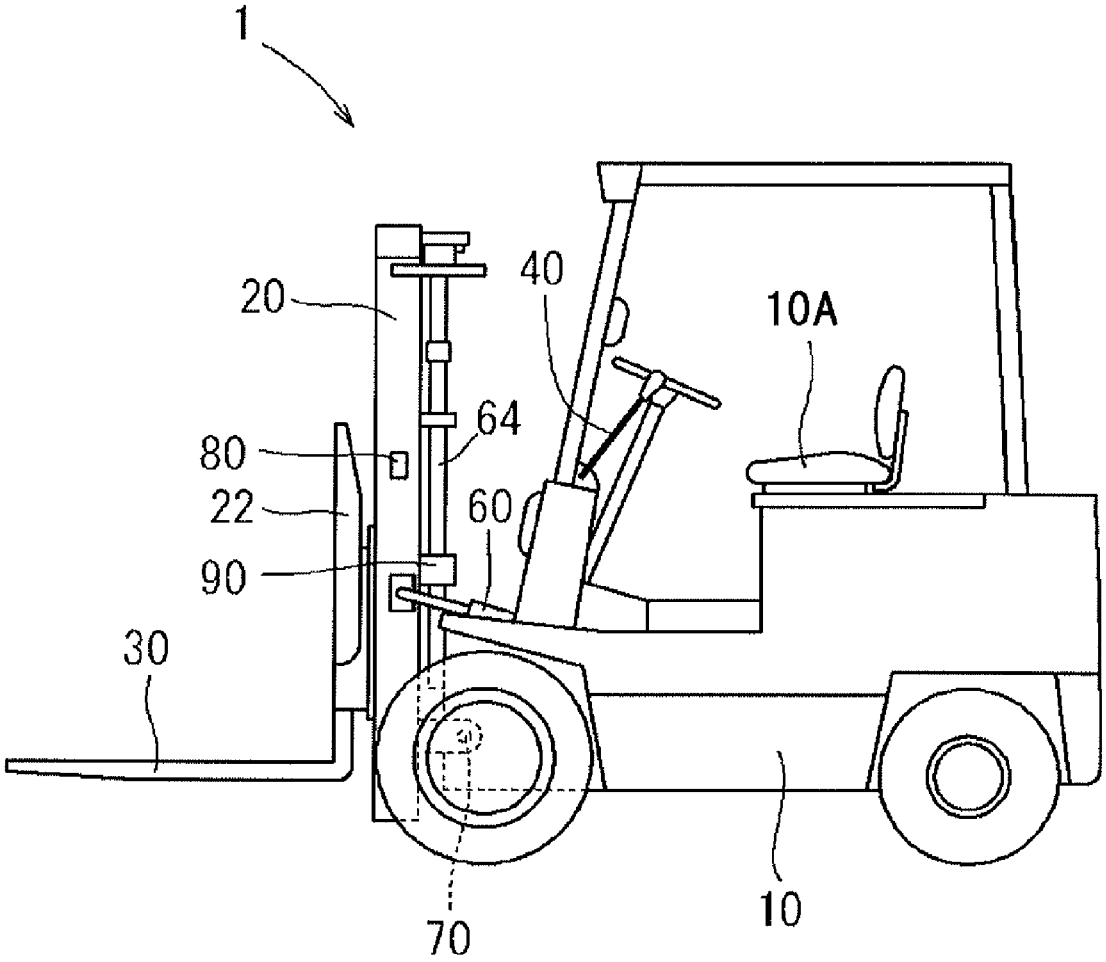
FIG. 1 is a schematic side view of a forklift truck according to a first preferred embodiment of the present invention.
Figure 2:
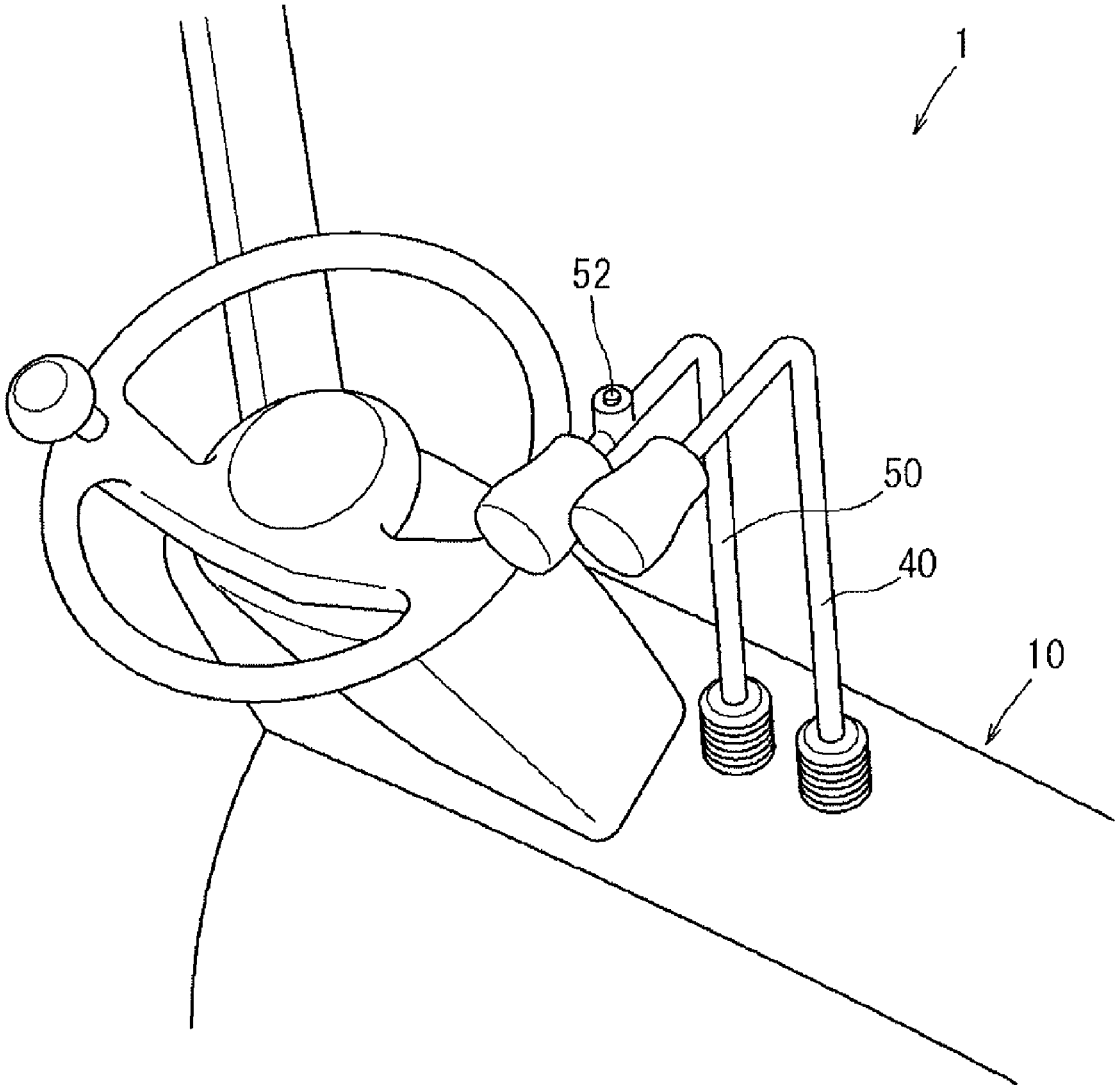
FIG. 2 is a partially enlarged perspective view of an operator's platform of the forklift truck of FIG. 1.

The following will describe a forklift truck according to a first preferred embodiment of the present invention with reference to FIGS. 1 through 5. Referring to FIGS. 1 through 2, the reference numeral 1 designates a forklift truck of the first preferred embodiment of the present invention. The following will describe the mechanical configuration and the electrical configuration of the forklift truck 1 separately.

The following will describe the mechanical configuration of the forklift truck 1 with reference to FIGS. 1 and 2. The forklift truck 1 includes a truck body 10, a mast 20 supported tiltably about a transverse axis of the truck body 10 and a fork 30 movable to be lifted and lowered through a lift bracket 22 relative to the mast 20.

The truck body 10 includes a tilt lever 40 and a lift lever 50 which are operable by an operator seated on the operator's seat. The forklift truck 1 includes a tilting mechanism (FIG. 3) in which the mast 20 is tiltable about a transverse axis of the truck body 10 by operating the tilt lever 40. The forklift truck 1 includes a lifting mechanism (FIG. 3) in which the fork 30 is movable to be lifted and lowered through the lift bracket 22 relative to the mast 20 by operating the lift lever 50. These tilting and lifting mechanisms 60, 64 will be described in detail later.

Figure 3:
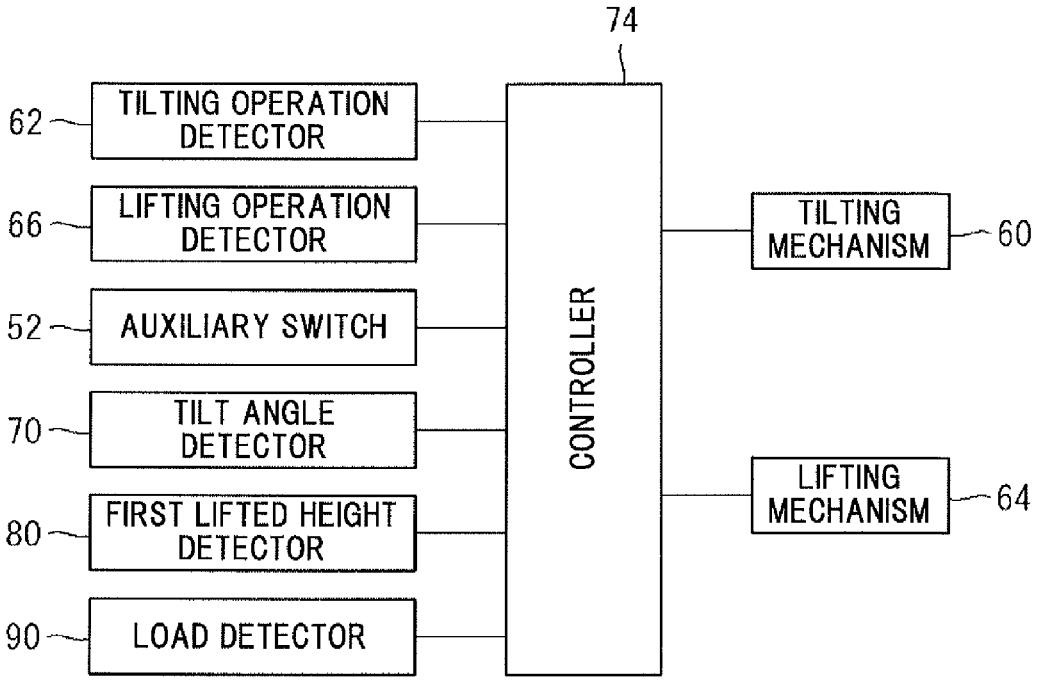
FIG. 3 is a block diagram showing the electrical arrangement of the forklift truck of FIG. 1.

Referring to FIG. 3, the following will describe the electrical configuration of the forklift truck 1. The forklift truck 1 includes the aforementioned tilting mechanism 60 and the lifting mechanism 64, a tilting operation detector 62, a lifting operation detector 66, an auxiliary switch 52, a tilt angle detector 70, a controller 74, a first lifted height detector 80 and a load detector 90 which are electrically connected.

The tilting mechanism 60 is used for tilting the mast 20 about a transverse axis of the truck body 10 and includes a tilt cylinder (not shown) connected to the mast 20, a pump (not shown) supplying pressurized oil to the tilt cylinder, a motor (not shown) driving the pump and an electromagnetic valve (not shown) operable to adjust the amount of the pressurized oil to be supplied to the tilt cylinder. It is noted that the pump and the motor are shared by the tilting mechanism 60 and the lifting mechanism 64. The electromagnetic valve is electrically connected to the controller 74 and controlled by a signal from the controller 74.

Adjusting the amount of oil to be supplied to the tilt cylinder, the extension and retraction of the tilt cylinder and hence the tilting operation of the mast 20 is controlled. The mast 20 is tilted according to the retraction of the tilt cylinder such that the fork 30 has a predetermined tilt angle. The controller 74 controls the operation of the electromagnetic valve thereby to control the tilting mechanism 60.

The tilting operation detector 62 is made of a lever switch and detects whether or not the tilt lever 40 is in operative position. The tilting operation detector 62 also detects the operation amount of the tilt lever 40. The tilting operation detector 62 is disposed adjacent to the bottom of the tilt lever 40 and electrically connected to the controller 74. The controller 74 receives from the tilting operation detector 62 signals indicative of whether or not the tilt lever 40 is operated by the operator and the operation amount of the tilt lever 40.

The lifting mechanism 64 which is used for lifting and lowering the fork 30 along the mast 20 through the lift bracket 22. Specifically, the lifting mechanism 64 includes a lift cylinder (not shown) operable to lift and lower the fork 30 along the mast 20, the aforementioned pump supplying pressurized oil to the lift cylinder, the aforementioned motor driving the pump and an electromagnetic valve (not shown) operable to adjust the amount of oil to be supplied to the tilt cylinder. The operation of the electromagnetic valve is controlled by a signal from the controller 74. Adjusting the amount of oil to be supplied to the lift cylinder, the extension and retraction of the lift cylinder and hence the lifting and lowering operation of the fork 30 is controlled.

The lifting operation detector 66 is made of a lever switch and detects whether or not the lift lever 50 is placed in operative position. The lifting operation detector 66 also detects the operation amount of the lift lever 50. The lifting operation detector 66 is disposed adjacent to the bottom of the lift lever 50 and electrically connected to the controller 74. The controller 74 receives from the lifting operation detector 66 a signal indicative of whether or not the lift lever 50 is operated by the operator of the lift lever 50 and the operation amount of the tilt lever 40.

The auxiliary switch 52 is made, for example, of a switch which may be kept closed only while the switch is held pressed and used for activating an automatic leveling mechanism which will be described later. As shown in FIG. 2, the auxiliary switch 52 is disposed adjacent to a knob of the lift lever 50 that is formed at the end of the lift lever 50 and has an enlarged diameter.

The auxiliary switch 52 is electrically connected to the controller 74. The controller 74 determines whether or not the auxiliary switch 52 is closed or in operative position by the operator based on a signal (information) outputted from the auxiliary switch 52.

The tilt angle detector 70 is made, for example, of a potentiometer and detects the tilt angle of the mast 20 relative to the horizontal position of the mast 20 to detect the tilt angle of the fork 30. The tilt angle detector 70 is disposed in the tilting mechanism 60 on the truck body 10 side of the tilt cylinder and electrically connected to the controller 74. The controller 74 detects the tilt angle of the fork 30 based on a signal (information) from the tilt angle detector 70. The controller 74 determines in real time whether the fork 30 is in a forward position, a horizontal position or a rearward position.

The first lifted height detector 80 is made, for example, of a limit switch and detects the lifted height of the fork 30 relative to the truck body 10. The first lifted height detector 80 is disposed in the mast 20 and electrically connected to the controller 74. The controller 74 detects the lifted height of the fork 30 based on a signal (information) outputted from the first lifted height detector 80. Specifically, the controller 74 determines in real time whether the lifted height of the fork 30 is at or lower than the first threshold value, that is, in a lower lift region L, or higher than the first threshold value, that is, in a higher lift region H. The first threshold value is determined based on previously obtained experimental data in view of the operational reliability of the forklift truck 1.

The load detector 90 is made, for example, of a sensor configured to detect any variation in hydraulic pressure of a hydraulic cylinder that forms a part of the lifting mechanism 64 and operable to detect whether or not a load is present on the fork 30. The hydraulic sensor detects the hydraulic pressure differential between the hydraulic cylinders before and after a load is placed on the fork 30 thereby to detect whether or not a load is present on the fork 30. The load detector 90 is electrically connected to the controller 74 and the controller 74 determines whether or not a load is present on the fork 30 based on a signal (information) from the load detector 90. The load detector 90 is not limited to the above hydraulic pressure sensor, but may be of any type of sensor as long as the presence of any load on the fork 30 is detected. A limit switch that is actuated by the presence of any load on the fork 30 may be mounted at any suitable position of the fork 30.

The controller 74 controls the loading and traveling operation of the forklift truck 1. Specifically, the controller 74 is used for controlling the operation of the tilting mechanism 60 and the lifting mechanism 64 based on a signal generated by the tilting operation detector 62, the lifting operation detector 66, the auxiliary switch 52, the tilt angle detector 70, the first lifted height detector 80 and the load detector 90, as well as controlling the traveling operation of the forklift truck 1. The controller 74 includes an electronic control unit (ECU) and a read only memory (ROM) storing therein programs which will be described in detail later.

The controller 74 determines according to a first program stored therein whether or not the tilt lever 40 is in operative position and the operation amount of the tilt lever 40 based on a signal from the tilting operation detector 62 and generates signals for controlling the operation of the tilting mechanism 60 or the electromagnetic valve thereof. Thus, the tilting speed of the fork 30 forward or rearward is determined based on the amount of the tilt lever operated by the operator. When the operation amount of the tilt lever 40 is relatively small, the fork 30 is tilted at a low tilting speed. When the operation amount of the tilt lever 40 is relatively large, the fork 30 is tilted at a high tilting speed.

The controller 74 determines according to the first program whether or not the lift lever 50 is placed in operative position and the operation amount of the lift lever 50 based on a signal from the lifting operation detector 66 and generates signals for controlling the operation of the lifting mechanism 64 or the electromagnetic valve thereof. Thus, the lifting and lowering speed of the fork 30 are determined based on the amount of the operation of the lift lever 50 by the operator. When the operation amount of the lift lever 50 is relatively small, the fork 30 is lifted or lowered at a low speed. When the operation amount of the lift lever 50 is relatively large, the fork 30 is lifted or lowered at a high speed.

The controller 74 also stores therein a second program according to which while performing the automatic leveling mechanism, the fork 30 is prevented from being tilted unless the fork 30 is located in a lower lift region and which will be described in detail in later part thereof.

Figure 4:
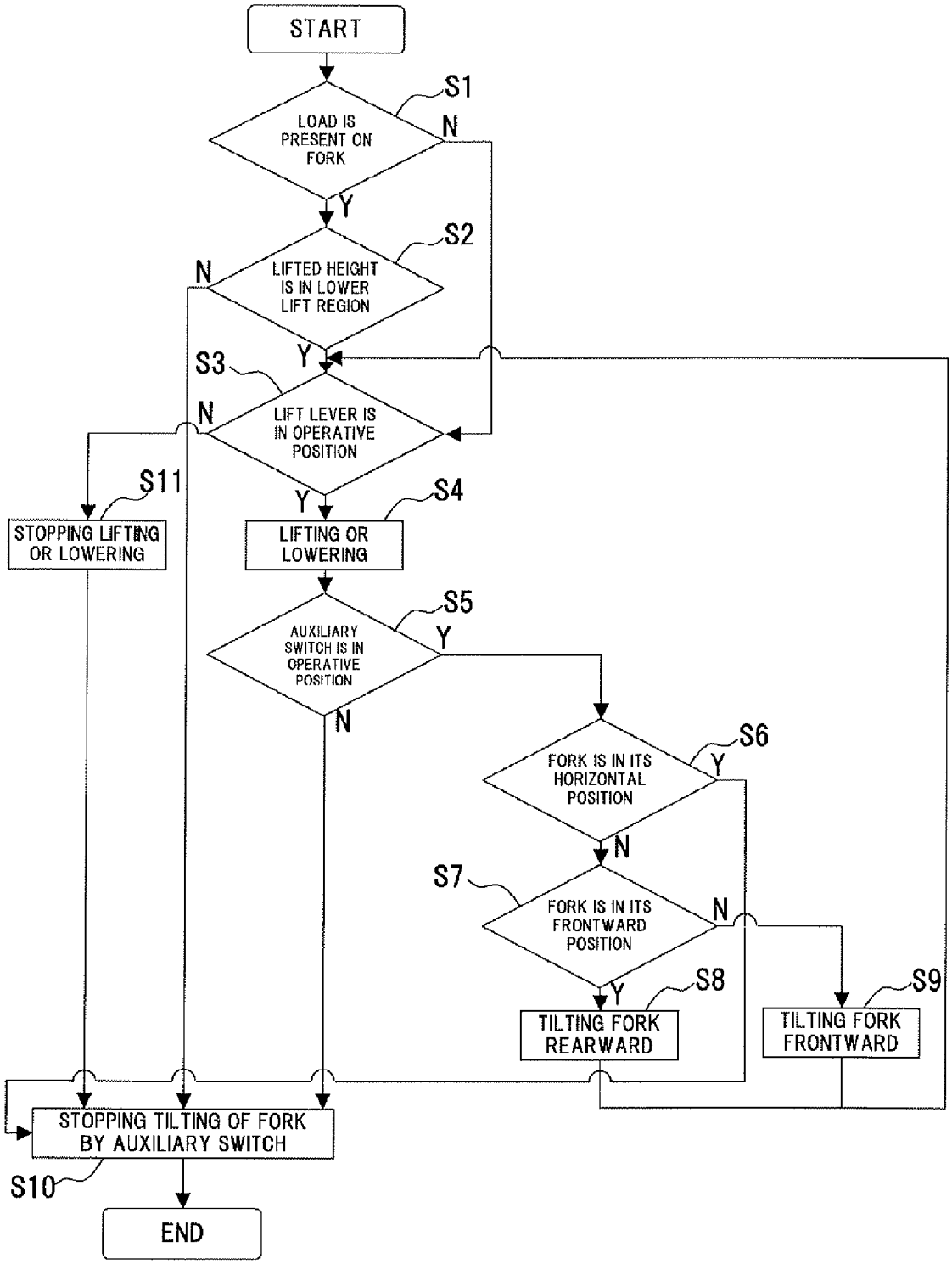
FIG. 4 is a flow chart illustrating the operation of the forklift truck of FIG. 1.
Figure 5:
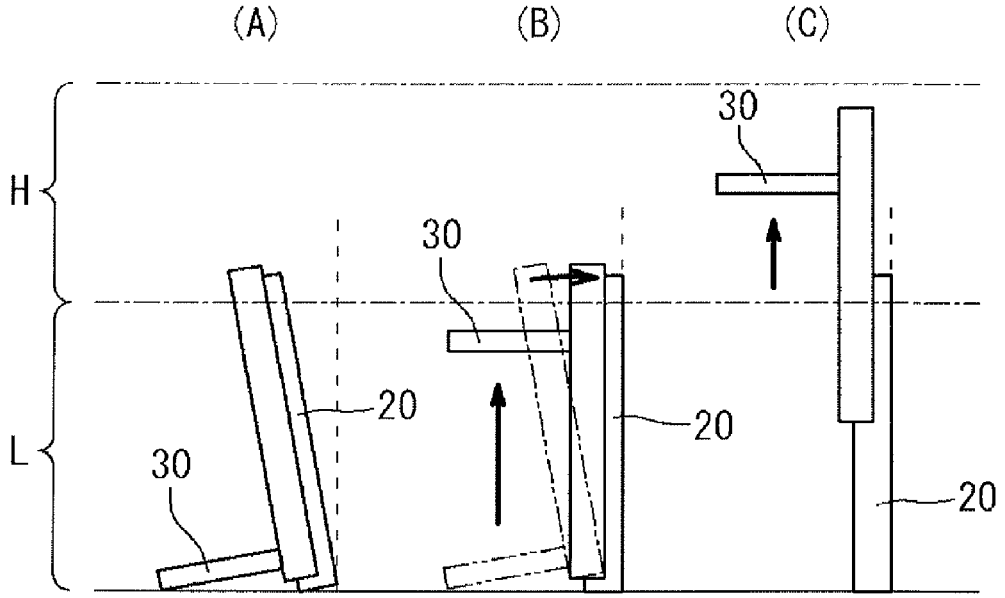
FIG. 5 is a schematic view showing the operation of the mast and the fork of the forklift truck of FIG. 1.

The following will describe the above-mentioned second program of the forklift truck 1 with reference to FIGS. 4 and 5. At the first step S1, the controller 74 determines based on a signal (information) from the load detector 90 whether or not a load is present on the fork 30. If YES (or Y) at step S1, the controller 74 determines at step S2 based on the a signal (information) from the first lifted height detector 80 whether or not the fork 30 is in the lower lift region L, as shown in FIG. 5 at (A).

If YES at step S2, or the fork 30 is in the lower lift region L, the controller 74 determines at step S3 based on the signal from the lifting operation detector 66 whether or not the lift lever 50 is placed in operative position. If YES at step S3, the controller 74 causes the fork 30 to be lifted at a speed that is determined by the operation amount of the lift lever 50 at step S4. Subsequently, the controller 74 determines at step S5 whether or not the auxiliary switch 52 is closed by the operator or in operative position. If YES at step S5, or the lift lever 50 is placed in operative position and the auxiliary switch 52 is in operative position, the controller 74 determines at step S6 based on the signal from the tilt angle detector 70 whether or not the fork 30 is in its horizontal position.

If NO at step S6, the controller 74 determines at step S7 whether or not the fork 30 is in its forward position relative to the tilting mechanism 60. If YES at step S7, or the fork 30 is in its forward position, the controller 74 causes the fork 30 to be tilted rearward at a normal speed as shown in FIG. 5 at (B) at step S8, and the sequence returns to step S3. If NO at step S7, or the fork 30 is in its rearward position, the fork 30 is tilted forward at a normal speed at step S9, and the sequence returns to step S3. The normal speed of tilting the fork 30 forward or rearward is previously set to an appropriate value in view of the desired efficiency in loading operation of the fork 30 and the safety in handling load on the fork 30.

While the lift lever 50 is placed in operative position and the auxiliary switch 52 is in operative position, the sequence is repeated by the controller 74 until the controller 74 determines at step S6 that the fork 30 is in its horizontal position or until it is determined YES at step S6. If YES at step S6, the controller 74 causes the tilting mechanism 60 to be stopped at step S10 and the sequence goes to end. The sequence is restarted at step S1 and repeated. After the fork 30 is tilted to its horizontal position, the fork 30 continues to be lifted, as shown in FIG. 5 at (C), while the lift lever 50 is placed in operative position.

Thus, while performing the automatic leveling mechanism, the fork 30 is prevented from being tilted to its horizontal position unless the fork 30 is in the lower lift region L. If NO at step S2, or no load is present on the fork 30, the step S2 proceeds to step 10. If NO at step S3, or the lift lever 50 is in inoperative position, the controller 74 causes the fork 30 to be stopped from lifting at step S11 by the controller 74 and the step S11 proceeds to step S10.

In the forklift truck 1 according to the first preferred embodiment of the present invention, tilting of the fork 30 to its horizontal position while lifting the fork 30 is allowed only when the fork 30 is in the lower lift region L. If the fork 30 is in the higher lift region H, the fork 30 is prevented from being tiled to its horizontal position. Therefore, movement of the fork 30 to its horizontal position is performed with safety and stability.

The following will describe a second preferred embodiment of the present invention. The second preferred embodiment differs from the first preferred embodiment in that the first threshold value, or the threshold value between the lower lift region L and the higher lift region H is changeable according to a load weight applied to the fork 30.

For this purpose, the load detector 90 includes a mechanism for detecting the load weight applied to the fork 30, as well as the mechanism for detecting whether or not a load is present on the fork 30. The load detector 90 is adapted to detect the variation of pressure of the hydraulic cylinder and includes a mechanism for determining the load weight applied to the fork 30.

According to the second preferred embodiment of the present invention, the first lifted height detector 80 may be of a type that permits continuous detection of the lifted height of the fork 30 instead of the limit switch of the first embodiment, for example a so-called reel type wherein an encoder is mounted on a reel connected to the fork or the lift bracket through a wire and the lifted height is determined from the number of rotations of the reel. The controller 74 determines in real time the lifted height of the fork 30 based on signals from the first lifted height detector 80.

The load detector 90 detects the load weight applied to the fork 30 and generates to the controller 74 a signal indicative of the detected load. The controller 74 has stored therein a program for changing the first threshold value according to the extent of the load weight applied to the fork 30. Specifically, the first threshold value is changed to a higher value when the detected load weight is lower than a predetermined reference value or changed to a lower value when the detected load weight is greater than the predetermined reference value. The relation between the load weight and the first threshold value is set previously based on experimental data.

According to the forklift truck 1 of the second preferred embodiment of the present invention, the first threshold value is changed according to the load weight on the fork 30. Therefore, when the load weight on the fork 30 is small, the range of the lifted height of the fork 30 in which the fork 30 is allowed to be lifted in its horizontal position may be widened while the safety and the stability of load on the fork 30 being maintained.

The following will describe a third preferred embodiment of the present invention with reference to FIGS. 4 and 6 through 9. According to the third preferred embodiment, the lifting speed of the fork 30 is changeable depending on the lifted height of the fork 30. As shown in FIGS. 6 and 7, a second lifted height detector 82 is provided in the forklift truck 1.

The second lifted height detector 82 is made of a limit switch and detects the lifted height of the fork 30 relative to the truck body 10. The second lifted height detector 82 is disposed at a position that is adjacent to the bottom of the mast 20 and lower than the first lifted height detector 80. The second lifted height detector 82 is electrically connected to the controller 74.

Thus, the controller 74 determines based on the a signal (information) from the second lifted height detector 82 whether the lifted height of the fork 30 is lower than the position corresponding to a second threshold value that is smaller than the first threshold value (or in the first lower lift region L1) or higher than the position (or in the second lower lift region L2 see FIG. 8).

The following will describe the operation of the forklift truck 1 according to the third preferred embodiment of the present invention. The operation of the forklift truck 1 of the third preferred embodiment of the present invention is substantially the same as that of the first preferred embodiment of the present invention. The forklift truck 1 of the third preferred embodiment differs from that of the first preferred embodiment in that the controller 74 determines at step S2 whether the fork 30 is in the first lower lift region L1 or in the second lower lift region L2 when the fork 30 is determined to be in the lower lift region L. If the controller 74 determines at step S2 that the fork 30 is in the first lower lift region L1, as shown in FIG. 8 at (A), the fork 30 is lifted at step S4 at a normal lifting speed and the fork 30 is tilted to its horizontal position at steps S8 and S9 at a normal tilting rearward speed, as shown in FIG. 8 at (B).

On the other hand, if the controller 74 determines at step S2 that the fork 30 is in the second lower lift region L2, as shown in FIG. 9 at (A), the fork 30 is lifted at step S4 at a low lifting speed and the fork 30 is tilted to its horizontal position at steps S8 and S9 at a normal tilting rearward speed or normal tilting frontward speed, as shown in FIG. 9 at (B). The above low lifting speed, which has been set previously based on experimental data in view of the desired efficiency in loading operation of the fork 30, as well as of the safety in handling load on the fork 30, will not affect the working efficiency of the forklift truck 1.

According to the forklift truck 1 of the third preferred embodiment, if the fork 30 is in the first lower lift region L1, the fork 30 is lifted at a normal lifting speed, while if the fork 30 is in the second lower lift region L2, the fork 30 is lifted at a low lifting speed. Thus, the lifting speed of the fork 30 is changed depending on the lifted height of the fork 30. Therefore, the tilting of the fork 30 to its horizontal position is performed at a relatively low lifted height of the fork 30, so that the fork 30 with a load may be lifted stably.

The following will describe the forklift truck 1 according to a fourth preferred embodiment of the present invention with reference to FIG. 10. The forklift truck 1 of the fourth preferred embodiment differs from that of the third preferred embodiment in that the tilting speed of the fork 30 to its horizontal position is changeable according to the lifted height of the fork 30.

Unlike the forklift truck 1 of the third preferred embodiment wherein the fork 30 located in the second lower lift region L2 is lifted at a low lifting speed that is lower than normal operation, the fork 30 in the same second lower lift region L2 is lifted at a normal lifting speed and the tilting of the fork 30 to its horizontal position is performed at a fast tilting speed that is faster than the normal, as shown in the drawings (A) and (B) of FIG. 10. According to the forklift truck 1 of the fourth preferred embodiment of the present invention, the lifting speed of the fork 30 in the second lower lift region L2 is normal. The tilting speed of the fork 30 to its horizontal position is faster than normal as shown in the drawings (A) and (B) of FIG. 10. Thus, the fork 30 is lifted at the normal lifting speed but tilted at a fast tilting speed so that the fork 30 located initially in the second lower lift region L2 may be tilted to its horizontal position before the fork 30 is lifted to a position corresponding to the first threshold value. Thus, the operation of the tilting of the fork 30 to its horizontal position is performed in a region of relatively low lifted height of the fork 30, so that the fork 30 with a load may be lifted stably. The tilting speed which is faster than the normal speed but lower than the speed when the lift lever 50 operated to its maximum position is previously set to an appropriate value based on experimental data in view of the safety in handling load on the fork 30.

Although the first through fourth preferred embodiments according to the present invention have been described, the present invention is not limited to such embodiments.

According to the first preferred embodiment, the fork 30 being lifted in the higher lift region H is prevented from tilting toward its horizontal position. The fork 30 being lowered in the higher lift region H may also be prevented form tilting toward its horizontal position. In this case, the determination of whether or not the fork 30 located in the higher lift region H is performed at step S2 and a step for determination of whether or not the lifted height of the fork 30 is in the lower lift region L is added after the determination at step S7. IfYES at step S2, the procedure proceeds to step S8 or S9.

According to the forklift truck 1 of the first preferred embodiment of the present invention, the fork 30 continues to be tilted toward its horizontal position after the fork 30 is lifted to the higher lift region H. However, the present invention is not limited to this structure. The forklift truck 1 of the first preferred embodiment may be modified and controlled by the controller 74 in such a way that the tilting of the fork 30 toward its horizontal position is stopped or the operation of the tilting mechanism 60 to lift the fork 30 is stopped when the fork 30 reaches the higher lift region H.

The following will describe the operation of the above modified forklift truck 1 with reference to FIG. 11. At step S101, the controller 74 determines whether or not a load is present on the fork 30. If YES at step S101, the controller 74 determines at step S102 whether or not the lifted height of the fork 30 is in the lower lift region L.

If YES at step S102, the controller 74 determines at step S103 whether or not the lift lever 50 is placed in operative position. If YES at step S103, the controller 74 causes at step S104 the fork 30 to be lifted. Then, the controller 74 determines at step S105 whether or not the auxiliary switch 52 is in operative position. If YES at step S105, the controller 74 determines at step S106 whether or not a load is present on the fork 30.

If YES at step S106, the controller 74 determines at step S107 whether or not the lifted height of the fork 30 is in the lower lift region L. If YES at step S107, the controller 74 determines at step S108 whether or not the fork 30 is in its horizontal position.

If NO at step S108, the controller 74 determines at step S109 whether or not the fork 30 is in its frontward position. If YES at step S109, the fork 30 is tilted rearward at S110 and the sequence returns to step S103. On the other hand, if NO at step S109, the fork 30 is tilted frontward at step S111 and the sequence returns to step S103.

Thereafter, continuing to operate the lift lever 50 and the auxiliary switch 52 by the operator, steps S103 through S111 are repeated until NO determination is made at step S107 or YES determination is made at step 108.

NO at step S107 means that the lifted height of the fork 30 is no more in the lower lift region L, or the fork 30 has reached the higher lift region H that is above the first threshold value level. Then at step 112, the controller 74 causes the fork 30 to stop its tilting frontward or rearward and the sequence goes to end.

YES at step S108 means that the fork 30 is in its horizontal position. Then at step S112, the controller 74 causes the fork 30 to stop its tilting forward or rearward and the sequence goes to end. The sequence is returned to step S101 and the step thereof is performed repeatedly.

If NO at step S102, the step S101 proceeds to S112. If NO at step S103, the controller 74 causes the fork 30 to stop the lifting at step S113 and the sequence goes to step S112. If NO at step S105, the sequence goes to step S112. If NO at step S106, the sequence goes to step S108.

According to the preferred embodiments, the auxiliary switch 52 is disposed adjacent to the knob of the lift lever 50. The auxiliary switch 52 may be disposed at any position near the operator's seat that allows the operator to operate the auxiliary switch 52 simultaneously with manipulation of the loading lever.

What is claimed is:

1. A forklift truck including a truck body, a fork and a mast movable to be lifted, lowered and tilted together with the fork, the forklift truck comprising:

a tilting mechanism adapted to tilt the mast relative to the truck body;

a tilt lever adapted to operate the tilting mechanism;

a tilting operation detector adapted to detect whether or not the tilt lever is in operative position;

a lifting mechanism adapted to lift and lower the fork along the mast;

a lift lever adapted to operate the lifting mechanism;

a lifting operation detector adapted to detect whether or not the lift lever is in operative position;

a lifted height detector detecting the lifted height of the fork;

a load detector adapted to detect whether or not a load is present on the fork;

an auxiliary switch disposed on the lift lever and at a position which allows the operator to operate the auxiliary switch;

a tilt angle detector adapted to detect a tilt angle of the mast; and a controller including executable program logic, configured to control the tilting mechanism and the lifting mechanism based on signals from the tilting operation detector, the lifting operation detector and the auxiliary switch, wherein the controller controls the lifting mechanism and the tilting mechanism to cause the fork to be lifted and tilted to horizontal position of the fork when all of the following conditions are satisfied, the load detector detects that a load is present on the fork, the fork is in a lower lift region where the lifted height of the fork detected by the lifted height detector is at or lower than a first threshold value, the lifting operation detector detects that the lift lever is placed in operative position to lift the fork, the auxiliary switch is in operative position and the controller detects that the fork is not in the horizontal position of the fork based on a signal from the tilt angle detector.

2. The forklift truck according to claim 1, wherein the controller controls only the lifting mechanism to cause the fork to be lowered if the load detector detects that a load is present on the fork and the fork is in a higher lift region where the lifted height of the fork detected by the lifted height detector is higher than the first threshold value, the lifting operation detector detects that the lift lever is placed in operative position to lower the fork and the auxiliary switch is in operative position, and the controller controls the lifting mechanism and the tilting mechanism to cause the fork to be lowered and tilted to horizontal position of the fork if the load detector detects that a load is present on the fork and the fork is in the lower lift region, the lifting operation detector detects that the lift lever is placed in operative position to lower the fork and the auxiliary switch is in operative position.

3. The forklift truck according to claim 1, wherein while the controller controls the lifting mechanism and the tilting mechanism to cause the fork in the lower lift region to be lifted and tilted to the horizontal position of the fork, the tilting of the fork to the horizontal position of the fork is stopped if the fork reaches the higher lift region.

4. The forklift truck according to claim 1, wherein the load detector is further adapted to detect a load weight applied to the fork, the lifted height detector permits continuous detection of the lifted height of the fork and the controller changes the first threshold value according to the load weight.

5. The forklift truck according to claim 1, wherein a tilting speed of the mast is changeable by the tilting mechanism to a normal tilting speed or a fast tilting speed which is faster than the normal tilting speed, a lifting speed of the fork is changeable by the lifting mechanism to a normal lifting speed or a low lifting speed which is lower than the normal lifting speed, the controller controls the lifting mechanism and the tilting mechanism to cause the fork to be lifted at the normal lifting speed and tilted to horizontal position of the fork at the normal tilting speed if the lifting operation detector detects that the lift lever is placed in operative position to lift the fork, the auxiliary switch is in operative position, the load detector detects that a load is present on the fork, the fork is in the lower lift region, the lifted height of the fork detected by the lifted height detector is at or lower than a second threshold value which is lower than the first threshold value and the controller detects that the fork is not in the horizontal position of the fork based on a signal from the tilt angle detector, and the controller controls the lifting mechanism and the tilting mechanism to cause the fork to be lifted at the low lifting speed and tilted to horizontal position of the fork at the normal tilting speed or lifted at the normal lifting speed and tilted to the horizontal position of the fork at the high tilting speed if the lifting operation detector detects that the lift lever is placed in operative position to lift the fork, the auxiliary switch is in operative position, the load detector detects that a load is present on the fork, the fork is in the lower lift region, the lifted height of the fork detected by the lifted height detector is higher than the second threshold value and the controller detects that the fork is not in the horizontal position of the fork based on a signal from the tilt angle detector.

6. A method for controlling a forklift truck, the forklift truck including:

a truck body;

a fork;

a mast movable to be lifted, lowered and tilted together with the fork;

a tilting mechanism adapted to tilt the mast relative to the truck body;

a tilt lever adapted to operate the tilting mechanism;

a tilting operation detector adapted to detect whether or not the tilt lever is placed in operative position;

a lifting mechanism adapted to lift and lower the fork along the mast;

a lift lever adapted to operate the lifting mechanism;

a lifting operation detector adapted to detect whether or not the lift lever is placed in operative position;

a lifted height detector adapted to detect the lifted height of the fork;

a load detector adapted to detect whether or not a load is present on the fork;

an auxiliary switch disposed on the lift lever and at a position which allows the operator to operate the auxiliary switch;

a tilt angle detector adapted to detect a tilt angle of the mast; and a controller including executable program logic, configured to control the tilting mechanism and the lifting mechanism based on signals from the tilting operation detector, the lifting operation detector and the auxiliary switch, the method comprising the steps of:

controlling the lifting mechanism to cause the fork to be lowered when all of the following conditions are satisfied, the load detector detects that a load is present on the fork, the fork is in a higher lift region where the lifted height of the fork detected by the lifted height detector is higher than a first threshold value, the lifting operation detector detects that the lift lever is placed in operative position to lower the fork and the auxiliary switch is in operative position or controlling the lifting mechanism and tilting mechanism to cause the fork to be lifted and tilted to the horizontal position of the fork if the load detector detects that a load is present on the fork and the fork is in a lower lift region where the lifted height of the fork detected by the lifted height detector is at or lower the first threshold value, the lifting operation detector detects that the lift lever is placed in operative position to lift the fork and the auxiliary switch is in operative position; and controlling the tilting mechanism to cause the fork to be tilted to horizontal position of the fork if the fork reaches the lower lift region from the higher lift region or controlling the tilting mechanism to cause the fork to be stopped from tilting if the fork is reaches the higher lift region from the lower lift region.

7. The method according to claim 6, wherein the load detector is further adapted to detect a load weight applied to the fork, the lifted height detector permits continuous detection of the lifted height of the fork and the controller changes the first threshold value according to the load applied to the fork.

* * * * *